United States Patent [19]

Bruni et al.

[11] 3,941,444

[45] Mar. 2, 1976

[54] SEALING MEMBER

[75] Inventors: Aldo Bruni; Luigi Campari, both of Turin, Italy

[73] Assignee: AMP Incorporated, Harrisburg, Pa.

[22] Filed: July 24, 1974

[21] Appl. No.: 491,184

[30] Foreign Application Priority Data

Aug. 1, 1973 Italy ..... 21999/73

[52] U.S. Cl. ..... 339/60 M; 339/94 M

[51] Int. Cl.[2] ..... H01R 7/02

[58] Field of Search ... 339/60 R, 60 C, 60 M, 94 R, 339/94 A, 94 C, 94 M, 96

[56] References Cited

UNITED STATES PATENTS

| | | | |
|---|---|---|---|
| 2,619,515 | 11/1952 | Doane | 339/94 M |
| 2,719,956 | 10/1955 | Leighton | 339/60 R |
| 3,337,836 | 8/1967 | Churla | 339/217 S |
| 3,596,231 | 7/1971 | Melton | 339/96 |
| 3,792,415 | 2/1974 | Fuller | 339/60 R |

*Primary Examiner*—Roy Lake
*Assistant Examiner*—Mark S. Bicks
*Attorney, Agent, or Firm*—William J. Keating; Jay L. Seitchik; Frederick W. Raring

[57] ABSTRACT

A hollow sealing member open at one end for receiving an electrical connector has at its opposite end, a wall formed with a plurality of recesses closed by a frangible base. The shape of the recesses permits a relatively wide flat tab to be passed through the wall without reducing the sealing effect of the wall around the conductor to which the flat tab is crimped.

1 Claim, 3 Drawing Figures

SEALING MEMBER

The present invention relates to sealing members and in particular sealing members of resilient, rubber-like material including a hollow body part open at one end for receiving an electrical component.

According to the present invention, a sealing member of resilient, rubber-like material comprises a hollow body part at one end for receiving an electrical component at its opposite end, the hollow body part has a wall which is formed inwardly towards the interior of the body part to define on its outer surface at least one first recess which communicates with a relatively smaller generally cylindrical second recess coaxial with the first recess the transition between the first and second recesses defining a shoulder, a base 10 of the second recess being frangible to permit the passage of a flat tab contact terminating the end of a cylindrical conductor, through the wall, the tearing of the base being limited to the material of the second recess which embraces sealingly the cylindrical conductor extending rearwardly from the flat tab contact through the wall.

In a preferred embodiment, the first recess is generally cylindrical and a pair of diametrically opposed grooves extend substantially the length of the first recess.

An embodiment of the invention will now be described, by way of example, reference being made to the Figures of the accompanying diagrammatic drawings in which.

Figure 1:
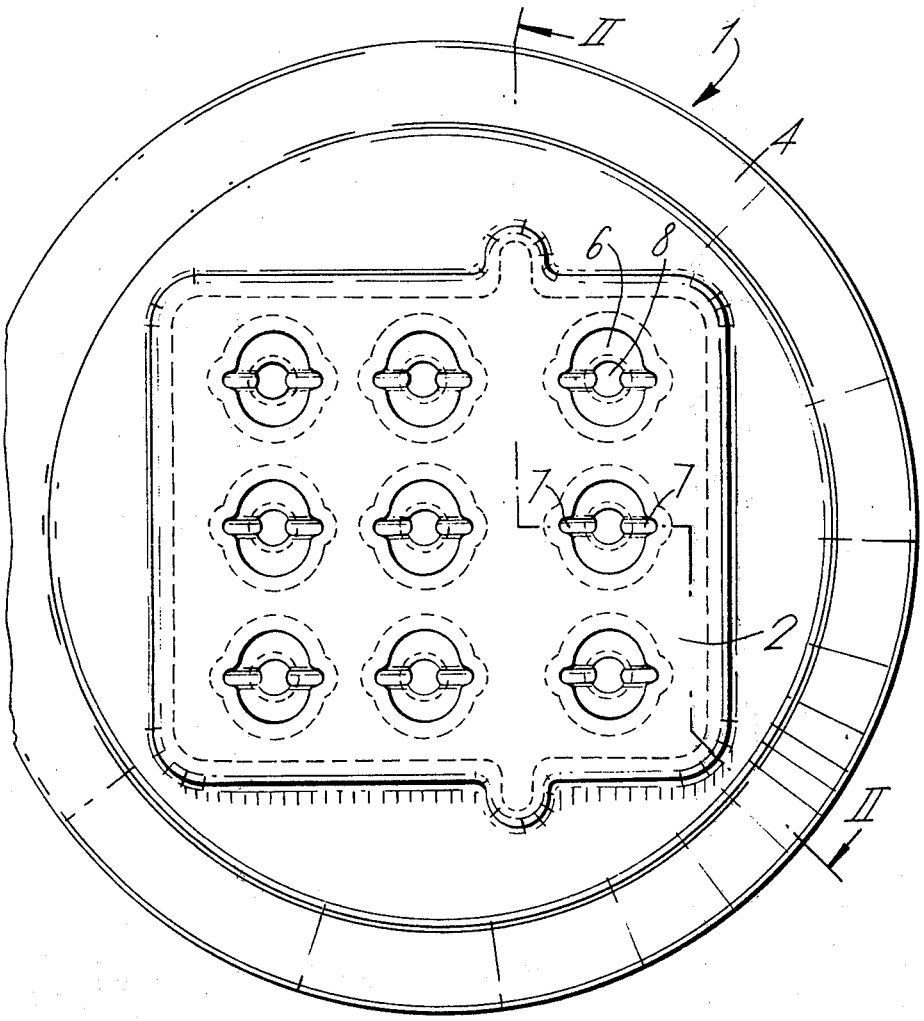
FIG. 1 is an end view of a sealing member.
Figure 2:
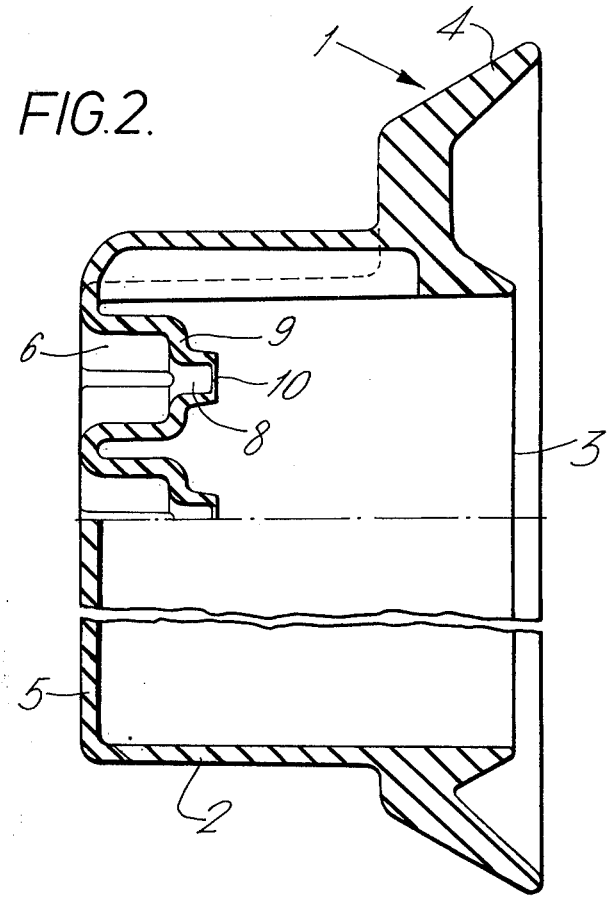
FIG. 2 is a cross-sectional view on the line II—II of FIG. 1.

As shown, the sealing member 1 of resilient rubber-like material includes a hollow body part 2 open at a forward end 3 for receiving an electrical component in the form of an electrical connector 12. At its end opposite the open forward end 3, the hollow body part 2 has a wall 5 which is formed inwardly towards the interior of the body part 2 with a plurality of generally cylindrical first recesses 6. Each recess 6 communicates with a relatively smaller generally cylindrical second recess 8 which is coaxial with the first recess 6. The transition between the first and second recesses 6 and 8 defines a shoulder 9. The base 10 of each recess 8 is made of thinner material than the other portions of the wall 5 and is thus rendered frangible. Each recess 6 is formed with a pair of diametrically opposed grooves 7 which extend substantially the length of the recess 6. The recesses 6 are arranged in columns and rows as shown most clearly in FIG. 1. The open forward end 3 of the hollow body part 2 is surrounded by a resilient flange 4 which extends forwardly of the end 3.

Figure 3:
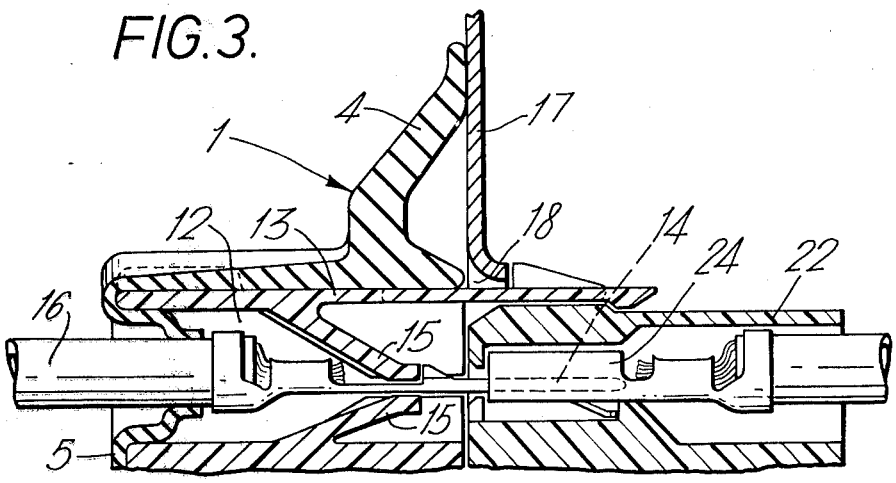
FIG. 3 is a detail, partly in cross-section of the sealing member of FIG. 1 assembled to an electrical connector in mating engagement with a complementary connector.

Referring in particular to FIG. 3, the hollow body part 2 is adapted to receive the electrical connector 12 which includes an insulating housing 13 contaning a plurality of flat tab contacts 14 each of which terminates a cylindrical conductor 16 (only one contact and one conductor shown). The flat tab contacts 14 are each wider than the diameter of their corresponding conductors 16. Each contact 14 is located and maintained in the housing 13 by resilient arms 15 integral with the housing 13 and by guides (not shown). The connector 12 is releasably mateable with a connector 22 which includes complementary tab receptacles 24. The connectors 12, 22 are mounted one on each side of a panel 17 and the flat tab contacts 14 extend through an aperture 18 in the panel 17. When the connectors 12, 22 are assembled, the flange 4 engages the panel 17 around the aperture 18 and forms a seal around the connector 12.

The flat tab contacts 14 are loaded and removed from the housing 13 via the rear end of the connector 12 and each flat tab contact 14 passes through the wall 5 of the member 1. The recesses 6 are arranged in the wall 5 of the member 1 in alignment with a position to be occupied by a flat tab contact 14.

On assembly, the housing 13 is first positioned in the hollow body part 2 via the forward open end 3 of the body part. The tab contacts 14 are then loaded in the housing 13 by passing each contact 14 through a recess 6 so that the side edges of the contact travel along the grooves 7. The flat tab contacts 14 are then pushed so that their free ends pierce the frangible base 10 of their respective recesses 8. Each contact 14 is then pushed into the housing 13 until it is latched into its predetermined position by the resilient arms 15. The sides of each recess 8 may be split slightly during the passage of the flat tab contact 14 through the base 10 but once the contact 14 has passed completely through the wall 5, the sides of the recess 8 close around the cylindrical conductor 16 to form a seal around the conductor.

It has been found, that the material forming the sides of the larger recess 6 provides the resilience necessary to avoid any excessive tearing effect on the material of the wall 5. Further, the material of the smaller recess 8, in effect, limits the amount of tearing if any which takes place so that the material of the shoulder 9 is substantially unaffected by the passage of the tab contact 14 through the base 10. The flat shoulder 9 supplies the necessary tightening effect around the cylindrical conductor 16.

The sealing member 1 can be made of vulcanized rubber having a basic elastomer of isoprene-isobutylene or copolymer ethylene-propylene or butadiene-stirene having a hardness of 35 to 40 Shore.

What is claimed is:

1. A sealing member of resilient, rubber-like material comprising a hollow body part open at one end for receiving an electrical component, at its opposite end, the hollow body part has a wall which is formed inwardly towards the interior of the body part to define on its outer surface at least one first recess which is generally cylindrical and which has a pair of diametrically opposed grooves extending substantially the length thereof, said first recess communicates with a relatively smaller generally cylindrical second recess coaxial with the first recess, the transition between the first and second recesses defining a shoulder, a base of the second recess being frangible to permit the passage of a flat tab contact terminating the end of a cylindrical conductor, through the wall, the conductor having a smaller outer periphery than that of the flat tab contact, the tearing of the base being limited to the material of the second recess which embraces sealingly the cylindrical conductor extending rearwardly from the flat tab contact through the wall.

* * * * *